US009285721B2

(12) United States Patent
Lu

(10) Patent No.: US 9,285,721 B2
(45) Date of Patent: Mar. 15, 2016

(54) TRANSFER UNIT AND IMAGE FORMING APPARATUS

(71) Applicant: KYOCERA Document Solutions Inc., Osaka (JP)

(72) Inventor: Lin Lu, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/446,950

(22) Filed: Jul. 30, 2014

(65) Prior Publication Data

US 2015/0037063 A1 Feb. 5, 2015

(30) Foreign Application Priority Data

Jul. 31, 2013 (JP) ..... 2013-159052

(51) Int. Cl.
*G03G 15/16* (2006.01)
*G03G 15/01* (2006.01)

(52) U.S. Cl.
CPC ..... *G03G 15/161* (2013.01); *G03G 15/0136* (2013.01); *G03G 15/1615* (2013.01)

(58) Field of Classification Search
CPC ..... G03G 15/161; G03G 16/1615; G03G 21/0005; G03G 15/0189; G03G 15/168
USPC ..... 399/101, 299, 302
See application file for complete search history.

(56) References Cited

U.S. PATENT DOCUMENTS 6,134,402 A 10/2000 Nakayama et al.
6,201,944 B1 * 3/2001 Onuki et al. ..... 399/299

FOREIGN PATENT DOCUMENTS

JP H11-038774 A 2/1999
JP H11-084972 A 3/1999
JP 2006330289 A * 12/2006
JP 2009-031450 A 2/2009
JP 2010107564 A * 5/2010
JP 2011257675 A * 12/2011

* cited by examiner

*Primary Examiner* — Erika J Villaluna
(74) *Attorney, Agent, or Firm* — Knobbe, Martens, Olson & Bear LLP

(57) ABSTRACT

A transfer unit includes: a transfer belt mounted over a plurality of rollers to run to transfer toner images on a plurality of image carriers to a front side of the transfer belt; transfer rollers provided for the respective image carriers to give a transfer potential to the transfer belt to transfer the toner images thereto; a drive mechanism configured to move only the transfer rollers for formation of a multicolor image into and out of contact with the transfer belt; a cleaning member contactable with a back side of the transfer belt to clean the back side; and a shifting mechanism configured to, upon contact of the transfer rollers with the transfer belt, shift the cleaning member into contact with the back side of the transfer belt and, upon departure of the transfer rollers from the transfer belt, shift the cleaning member out of contact with the back side.

1 Claim, 6 Drawing Sheets

TRANSFER UNIT AND IMAGE FORMING APPARATUS

INCORPORATION BY REFERENCE

This application claims priority to Japanese Patent Application No. 2013-159052 filed on Jul. 31, 2013, the entire contents of which are incorporated by reference herein.

BACKGROUND

The present disclosure relates to transfer units and image forming apparatuses.

An image forming apparatus is known in which toner images formed on respective peripheral surfaces of photosensitive drums (image carriers) of different colors for forming a multicolor image are once transferred to an endlessly running transfer belt to superpose the toner images of different colors on each other to form a multicolor toner image and the multicolor toner image is secondarily transferred to a recording medium to form a multicolor image. There is also known another image forming apparatus of a type in which toner images are transferred from photosensitive drums directly to a recording medium being conveyed by a transfer belt.

In the above image forming apparatuses, during transfer of toner from the photosensitive drums, the toner may scatter to contaminate the apparatus interior and in some cases contaminate even the back side of the transfer belt. To prevent deterioration of image quality due to unstable run of an intermediate transfer belt caused by deposition of scattering toner and other foreign matters on the back side of the transfer belt, a mechanism for cleaning the back side of the transfer belt is known.

SUMMARY

A technique improved over the aforementioned technique is proposed herein as one aspect of the present disclosure.

A transfer unit according to an aspect of the present disclosure includes a transfer belt, a plurality of transfer rollers, a drive mechanism, a cleaning member, and a shifting mechanism.

The transfer belt is mounted over a plurality of rollers to run thereover and configured so that respective toner images formed on a plurality of image carriers for different colors necessary to form multicolor and black-and-white images are transferred to a front side of the transfer belt or a recording medium placed on the front side of the transfer belt.

The plurality of transfer rollers are provided for the respective image carriers and configured to give a transfer potential to the transfer belt to allow the toner images to be transferred to the transfer belt.

The drive mechanism is configured to move, among the transfer rollers for formation of a multicolor image and the transfer roller for formation of a black-and-white image, the transfer rollers for formation of a multicolor image into and out of contact with the transfer belt.

The cleaning member is capable of contact with a back side of the transfer belt and operable to clean the back side of the transfer belt.

The shifting mechanism is configured to, when the drive mechanism moves the transfer rollers for formation of a multicolor image into contact with the transfer belt, shift the cleaning member to a position in contact with the back side of the transfer belt and, when the drive mechanism moves the transfer rollers for formation of a multicolor image out of contact with the transfer belt, shift the cleaning member to a position out of contact with the back side of the transfer belt.

An image forming apparatus according to another aspect of the present disclosure includes the aforementioned transfer unit, the plurality of image carriers, a plurality of charging sections, a plurality of exposure sections, a plurality of developing sections, and a second transfer section.

The plurality of charging sections are configured to charge respective peripheral surfaces of the image carriers.

The plurality of exposure sections are configured to expose the respective peripheral surfaces of the image carriers charged by the charging sections to light.

The plurality of developing sections are configured to supply toner to respective electrostatic latent images formed on the respective peripheral surfaces of the image carriers by the exposure of the exposure sections to develop the electrostatic latent images.

The second transfer section is configured to transfer a toner image on the transfer belt to a recording medium.

DETAILED DESCRIPTION

Figure 1:
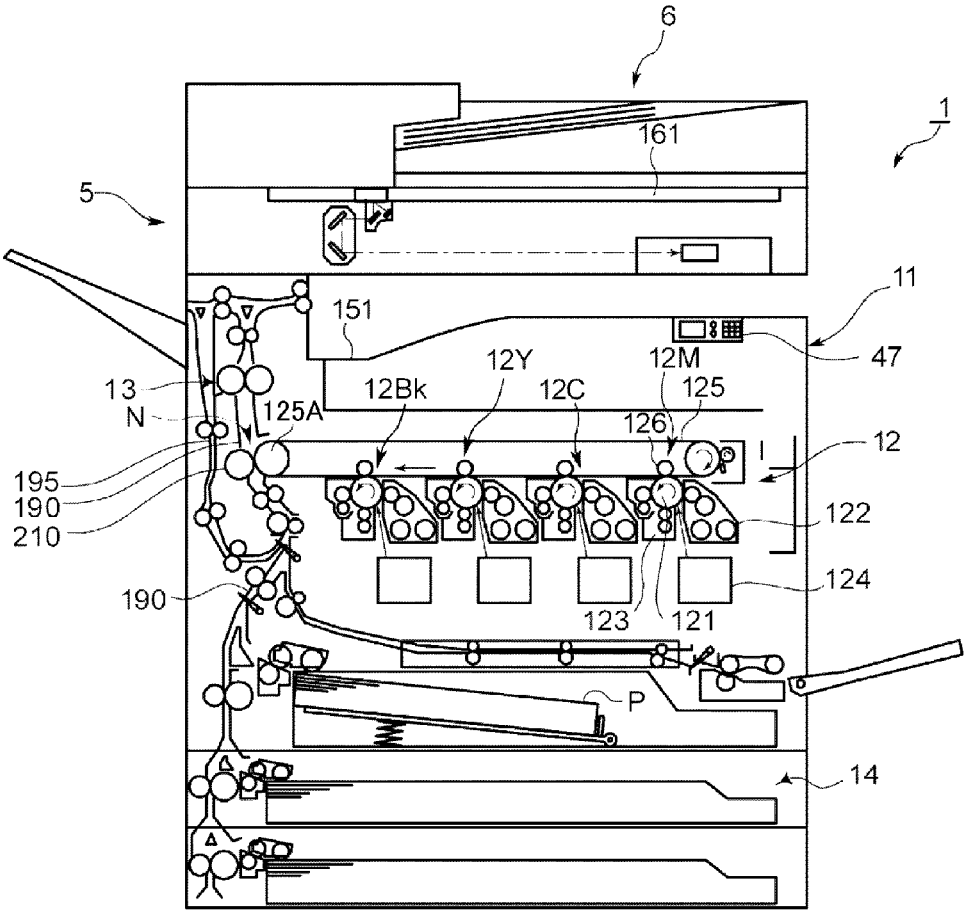
FIG. 1 is a front cross-sectional view showing the structure of an image forming apparatus including a transfer unit according to one embodiment of the present disclosure.

Hereinafter, a description will be given of one embodiment of the present disclosure with reference to the drawings. First, a description will be given of the structure of an image forming apparatus according to the embodiment of the present disclosure. FIG. 1 is a front cross-sectional view showing the structure of the image forming apparatus 1 according to the embodiment of the present disclosure.

As shown in FIG. 1, the image forming apparatus 1 is a multifunction peripheral having multiple functions including, for example, a copy function, a print function, a scan function, and a facsimile function. The image forming apparatus 1 is made up so that an apparatus body 11 thereof includes an operating section 47, an image forming section 12, a fixing section 13, a paper feed section 14, a document feed section 6, a document reading section 5, and so on.

In a document reading operation of the image forming apparatus 1, the document reading section 5 optically reads an image of an original document being fed from the document feed section 6 or an image of an original document placed on an original glass plate 161 to generate image data. The image data generated by the document reading section 5 is stored on an internal HDD, a network-connected computer or the like.

In an image forming operation of the image forming apparatus 1, the image forming section 12 forms a toner image on a recording paper sheet P serving as a recording medium fed from the paper feed section 14, based on image data generated by the document reading operation, image data stored on the internal HDD or like image data. Each of image forming units 12M, 12C, 12Y, and 12Bk of the image forming section 12 includes a photosensitive drum 121, a charging device 123, an exposure device 124, a developing device 122, and a primary transfer roller 126.

The developing device 122 of each of the image forming units 12M, 12C, 12Y, and 12Bk contains toner for developing an electrostatic latent image. The developing device 122 is configured to supply toner to the surface of the associated photosensitive drum 121 where charging of the charging device 123 and exposure of the exposure device 124 have been completed.

In the case of multicolor printing, the image forming unit 12M for magenta, the image forming unit 12C for cyan, the image forming unit 12Y for yellow, and the image forming unit 12Bk for black of the image forming section 12 form respective toner images on their respective photosensitive drums 121 through charging, exposure, and developing processes based on respective images of respective different color components constituting the above image data and then allow their respective primary transfer rollers 126 to transfer the toner images to an intermediate transfer belt (transfer belt) 125 mounted over a drive roller 125A and a driven roller 125B.

The intermediate transfer belt 125, the primary transfer rollers 126, the drive roller 125A, and the driven roller 125B are incorporated in an intermediate transfer unit 50. The outer peripheral surface of the intermediate transfer belt 125 is set to an image carrying surface to which toner images are to be transferred. The intermediate transfer belt 125 is driven by the drive roller 125A while engaging against the peripheral surfaces of the photosensitive drums 121. The intermediate transfer belt 125 endlessly runs between the drive roller 125A and the driven roller 125B while synchronizing with the rotation of each photosensitive drum 121.

The toner images of different colors transferred to the intermediate transfer belt 125 are superposed each other on the intermediate transfer belt 125 by controlling their transfer timings, resulting in a multicolor toner image. A secondary transfer roller 210 transfers the multicolor toner image formed on the outer peripheral surface of the intermediate transfer belt 125, at a nip N between the secondary transfer roller 210 and the drive roller 125A with the intermediate transfer belt 125 in between, to a recording paper sheet P conveyed from the paper feed section 14 along a conveyance path 190. Thereafter, the fixing section 13 fixes the toner image on the recording paper sheet P by the application of heat and pressure. The recording paper sheet P having a multicolor image fixed thereon by the completion of the fixing treatment is discharged to a paper output tray 151.

Next, a description will be given of the intermediate transfer unit 50.

Figure 2:
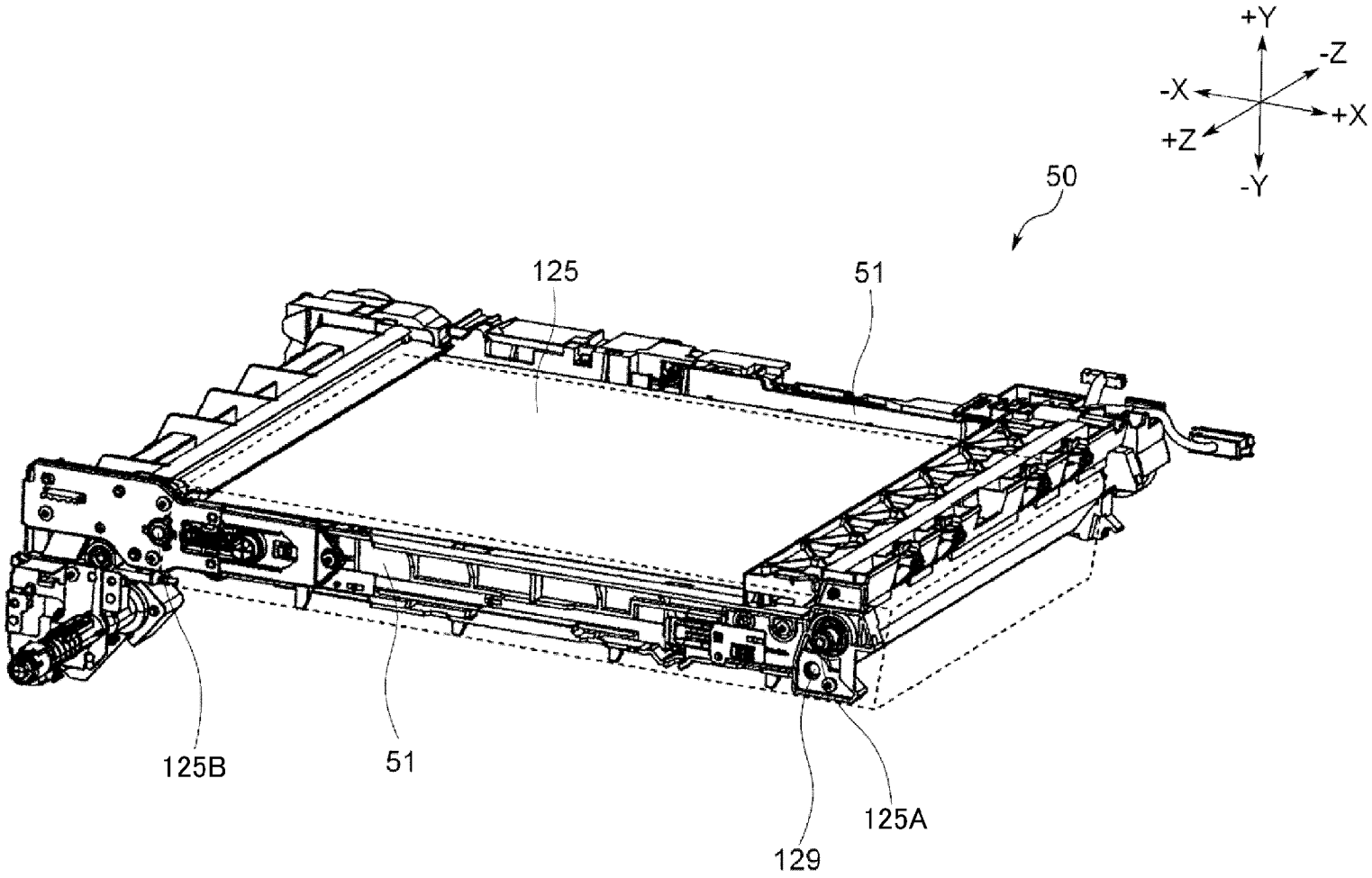
FIG. 2 is a perspective view showing a schematic structure of the interior of a casing of an intermediate transfer unit.

FIG. 2 is a perspective view showing a schematic structure of the interior of a casing of the intermediate transfer unit 50.

Figure 3:
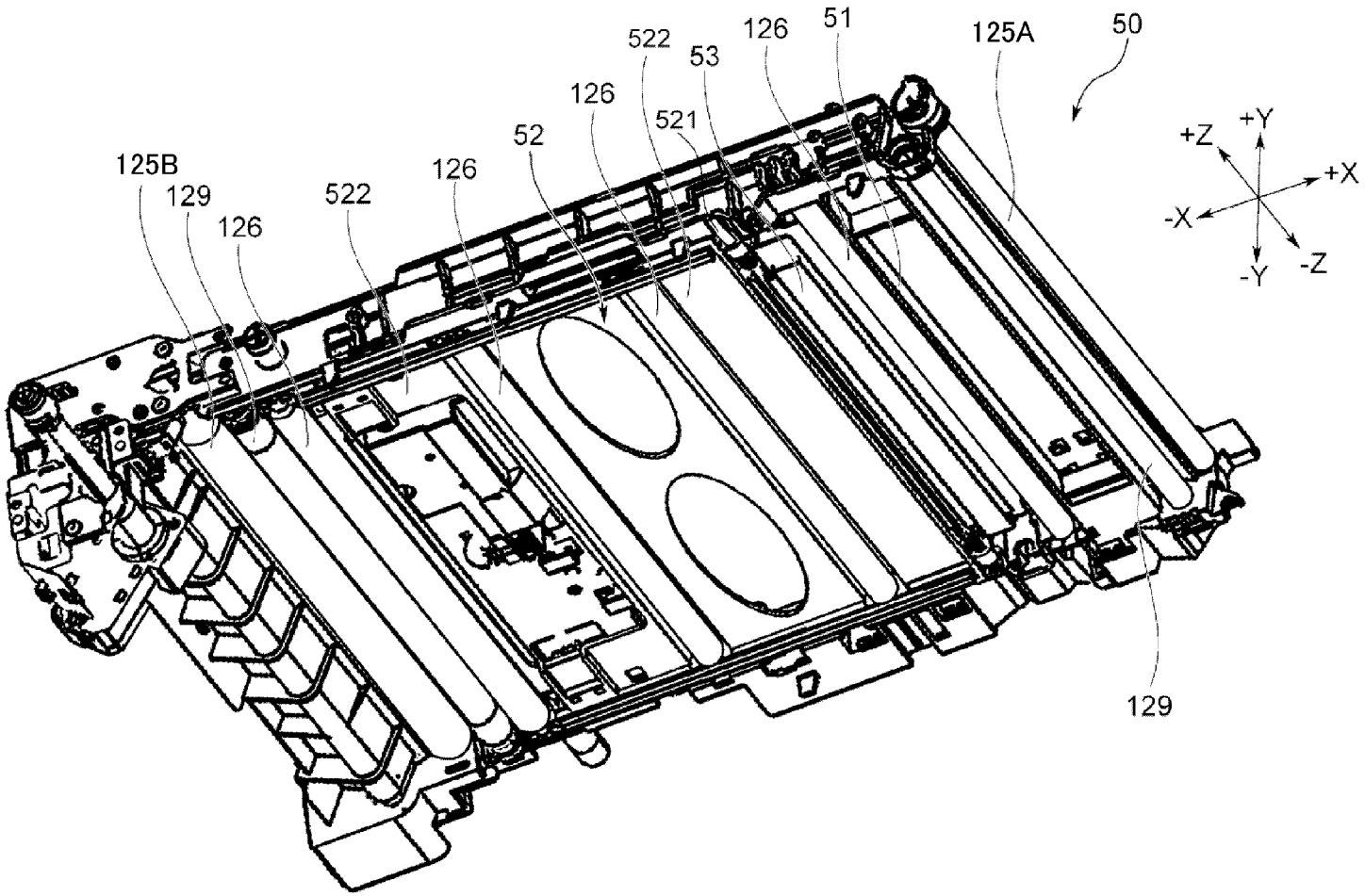
FIG. 3 is a perspective view showing the appearance of the intermediate transfer unit when viewed from below in FIG. 2.

FIG. 3 is a perspective view showing the appearance of the intermediate transfer unit 50 when viewed from below in FIG. 2. Note that FIG. 3 shows a state where the intermediate transfer belt 125 is removed.

As described previously, the intermediate transfer unit 50 incorporates the intermediate transfer belt 125, the primary transfer rollers 126, the drive roller 125A, and the driven roller 125B.

A frame 51 supports various mechanisms incorporated in the intermediate transfer unit 50. Mounted to the frame 51 are the primary transfer rollers 126, the drive roller 125A, the driven roller 125B as well as two backup rollers 129, a primary transfer roller 126 of an image forming unit 12Bk for black, a cleaning unit 53, and a drive mechanism 52.

The backup rollers 129 are configured to press the intermediate transfer belt 125 mounted over the drive roller 125A and the driven roller 125B outwardly from inside the intermediate transfer belt 125 to apply tension to the intermediate transfer belt 125.

The drive mechanism 52 supports, among the primary transfer rollers 126 for formation of a multicolor image and the primary transfer roller 126 for formation of a black-and-white image, the primary transfer rollers 126 for formation of a multicolor image, i.e., the respective primary transfer rollers 126 of the image forming unit 12M for magenta, the image forming unit 12C for cyan, and the image forming unit 12Y for yellow. The drive mechanism 52 is a mechanism for moving these primary transfer rollers 126 for formation of a multicolor image into and out of contact with the intermediate transfer belt 125.

Figure 5:
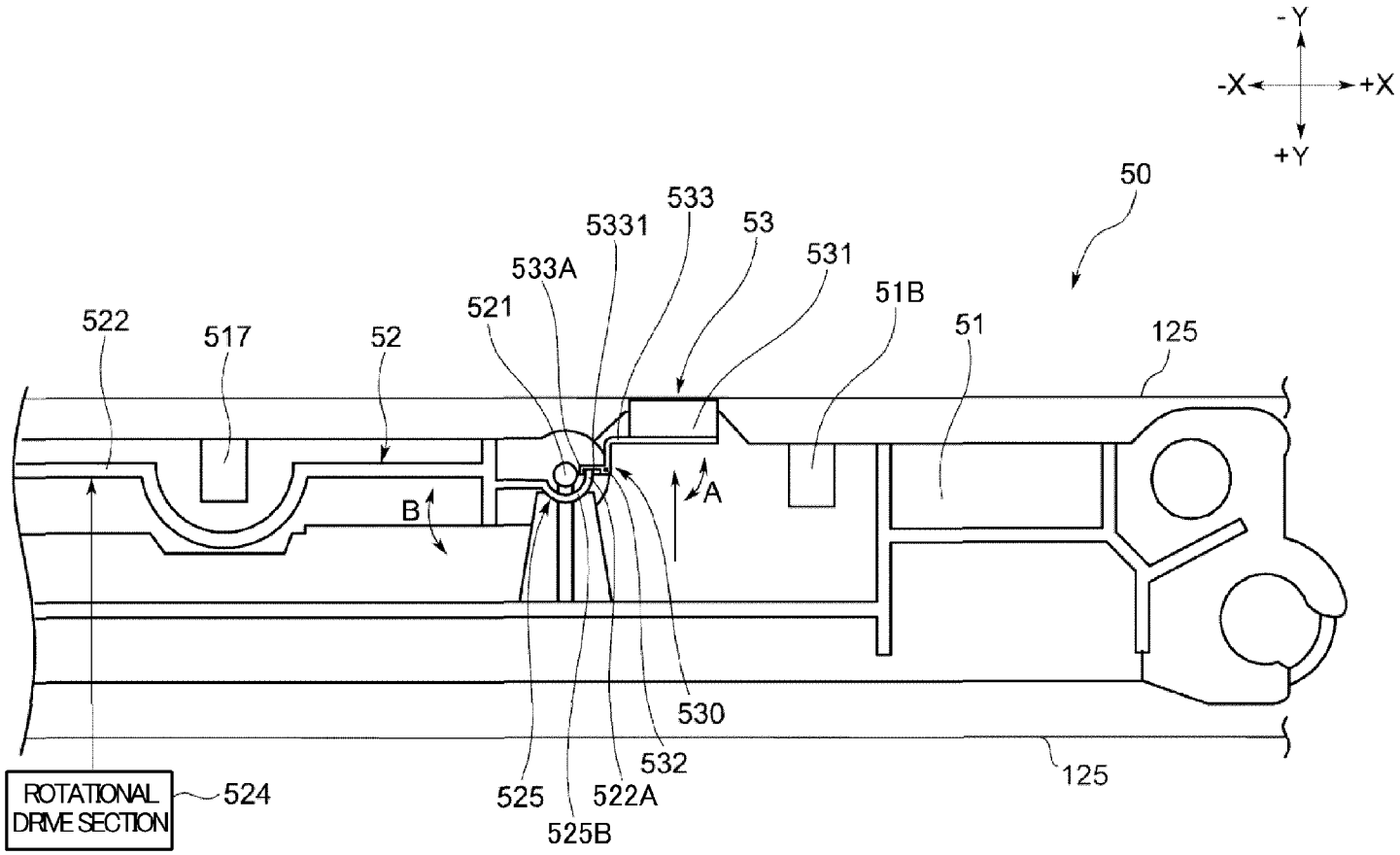
FIG. 5 is a side view of the intermediate transfer unit, showing a region where a drive mechanism and a cleaning unit engage each other.

The drive mechanism 52 includes a pair of first pivot shafts 521, a first support member 522, and a rotational drive section 524 (see FIG. 5).

The first pivot shafts 521 extend in a direction along the rotational axes of the drive roller 125A and the driven roller 125B. The first pivot shafts 521 serve as fulcrums for turning the first support member 522 in directions toward and away from the frame 51 and the intermediate transfer belt 125.

The first support member 522 rotatably journals the primary transfer rollers 126 for formation of a multicolor image arranged in a row in a direction of run of the intermediate transfer belt 125. The first support member 522 is configured to turn on the first pivot shafts 521 as fulcrums. By this turning movement, the first support member 522 moves the primary transfer rollers 126 for formation of a multicolor image in directions toward and away from contact with the back side of the intermediate transfer belt 125.

The rotational drive section 524 includes a drive source configured to supply a rotational drive force, a rotary shaft rotatable by a rotational drive force supplied from the drive source, a cam having different diameters at different circumferential positions of its peripheral surface and configured to corotate with the rotary shaft, an unshown pressing part configured to press the first support member 522 in a direction away from the back side of the intermediate transfer belt 125 and the frame 51 and formed of, for example, a pressing spring, and a control unit configured to control the drive of the drive source. The cam is rotatably mounted, with its peripheral surface in contact with the first support member 522, to the intermediate transfer unit 50. When the cam rolls on the first support member 522 to change the amount of pressing of the first support member 522 toward the back side of the intermediate transfer belt 125 and the frame 51 against the pressing of the pressing part, the first support member 522 turns, with the rotation of the cam, in directions toward and away from contact with the back side of the intermediate transfer belt 125. Depending upon differences in diameter among circumferential positions of the peripheral surface of the cam, the first support member 522 changes from a position in contact with the back side of the intermediate transfer belt 125 to a position out of contact therewith or vice versa.

In forming a multicolor image, the control unit controls the drive of the drive source to rotate the cam and stop the rotation of the cam at a position where the distance from the center of rotation of the cam to the peripheral surface thereof (to the first support member 522) reaches, for example, the maximum. In this state, the amount of pressing of the first support member 522 toward the back side of the intermediate transfer belt 125 reaches, for example, the maximum and the control unit is configured to move the first support member 522 to a position where all the primary transfer rollers 126 for different colors for formation of a multicolor image come into contact with the back side of the intermediate transfer belt 125.

On the other hand, in forming a black-and-white image, the control unit controls the drive of the drive source to rotate the cam and stop the rotation of the cam at a position where the distance from the center of rotation of the cam to the peripheral surface thereof reaches, for example, the minimum. In this state, the amount of pressing of the first support member 522 toward the back side of the intermediate transfer belt 125 reaches, for example, the minimum and the control unit is configured to turn the first support member 522 to a position where all the primary transfer rollers 126 for different colors for formation of a multicolor image are away from the back side of the intermediate transfer belt 125.

The cleaning unit 53 is a mechanism for cleaning the back side (inner surface) of the intermediate transfer belt 125. The cleaning unit 53 includes a cleaning member 531 (see FIG. 4) and a shifting mechanism 530 (see FIG. 4). The details of the cleaning unit 53 will be described hereinafter.

The drive roller 125A is rotatably journaled at one end of the frame 51 and the driven roller 125B is journaled at the other end thereof. The intermediate transfer belt 125 is mounted between both the drive roller 125A and driven roller 125B journaled in the above manner and is, in this state, capable of running with the rotation of the drive roller 125A and in the direction of rotation thereof. All the primary transfer rollers 126 are disposed inside the intermediate transfer belt 125 mounted in the above manner.

Next, a further description will be given of the structures of the drive mechanism 52 and the cleaning unit 53.

Figure 4:
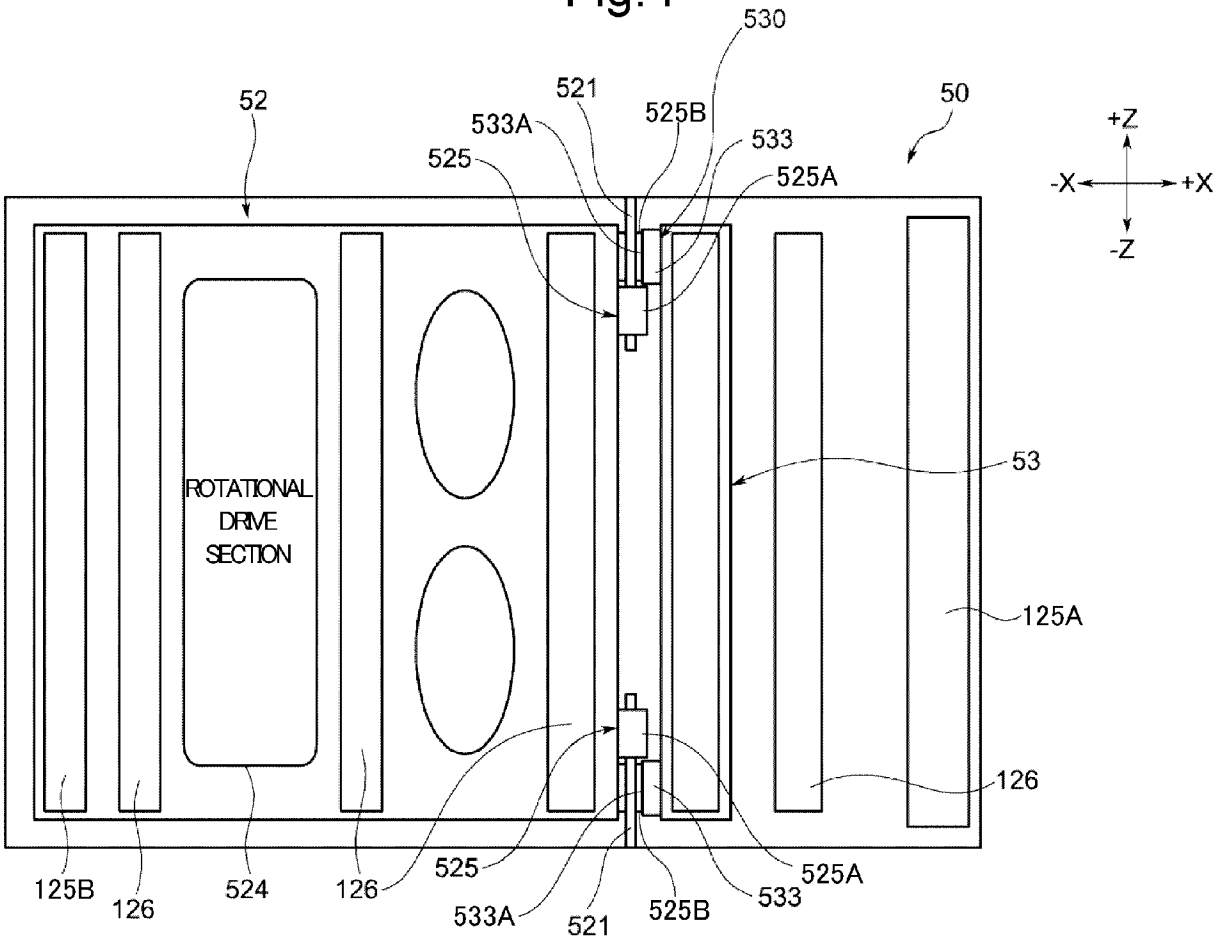
FIG. 4 is a plan view showing the intermediate transfer unit when viewed from below in FIG. 3 and shows a schematic structure of the intermediate transfer unit.

FIG. 4 is a plan view showing the intermediate transfer unit 50 when viewed from below in FIG. 3 and shows a schematic structure of the intermediate transfer unit 50.

FIG. 5 is a side view of the intermediate transfer unit 50, showing a region where the drive mechanism 52 and the cleaning unit 53 engage each other.

First, a description will be given of the structure of the cleaning unit 53. The cleaning unit 53 includes a cleaning member 531 and a shifting mechanism 530.

The cleaning member 531 extends in the direction along the rotational axes of the drive roller 125A and the driven roller 125B and has a length close to the width of the intermediate transfer belt 125 (the dimension thereof in a direction perpendicular to the direction of run thereof). The cleaning member 531 is capable of contact with the back side of the intermediate transfer belt 125 and is operable to clean (brush) the back side of the intermediate transfer belt 125 by scraping waste toner, dust, and so on deposited on the back side with friction against the back side when making contact therewith. The cleaning member 531 is made of an electrically conductive material.

The shifting mechanism 530 is a turning mechanism configured to turn the cleaning member 531 in directions toward and away from contact with the back side of the intermediate transfer belt 125. The shifting mechanism 530 includes a pair of second pivot shafts 532 and a second support member 533.

The second pivot shafts 532 extend in the direction along the rotational axes of the drive roller 125A and the driven roller 125B. The second pivot shafts 532 serve as fulcrums for turning the second support member 533 in directions toward and away from the frame 51 and the intermediate transfer belt 125.

The second support member 533 extends in the direction along the aforementioned rotational axes like the cleaning member 531 and supports the cleaning member 531. The second support member 533 is attached to a surface of the cleaning member 531 opposite to another surface of the cleaning member 531 facing the back side of the intermediate transfer belt 125. The second support member 533 is configured to turn on the second pivot shafts 532 as fulcrums in the directions of the arrows A while supporting the cleaning member 531. Thus, the second support member 533 can turn the cleaning member 531 in the directions toward and away from contact with the back side of the intermediate transfer belt 125. The cleaning unit 53 is disposed opposite the first support member 522 side of the first pivot shafts 521 in the direction of run of the intermediate transfer belt 125 where the primary transfer rollers 126 for formation of a multicolor image are disposed.

Subsequently, a description will be given of the structure of mechanism in which the drive mechanism 52 and the cleaning unit 53 engage each other.

The first support member 522 of the drive mechanism 52 is provided with a pair of engagement portions 525 engaging with the respective associated first pivot shafts 521. Each of the engagement portions 525 includes a first engagement portion 525A and a second engagement portion 525B. The first engagement portion 525A engages with one side portion of the associated first pivot shaft 521. The second engagement portion 525B engages with the other side portion of the associated first pivot shaft 521. Each of the first pivot shafts 521 is embraced by these first and second engagement portions 525A, 525B of the engagement portion 525. Thus, the engagement portions 525 are journaled by the first pivot shafts 521 to allow the first support member 522 to turn in the directions of the arrows B.

On the other hand, the second support member 533 of the shifting mechanism 530 is provided, at end portions opposite the side thereof where the cleaning member 531 is supported with respect to the second pivot shafts 532, with second hooking portions 533A hooking over ends of the second engagement portions 525B.

Each second hooking portion 533A includes a recess 5331. The recess 5331 is formed in a size that allows the end of the second engagement portion 525B to fit therein. The ends of the second engagement portions 525B fit as first hooking portions 522A into the respective associated recesses 5331, whereby the first support member 522 engages with the second support member 533.

As described previously, the first support member 522 supporting the primary transfer rollers 126 for formation of a multicolor image is pressed by the pressing part to turn in the direction away from the back side of the intermediate transfer belt 125. On the other hand, the second support member 533 supporting the cleaning member 531 is pressed by an unshown pressing member to turn the cleaning member 531 in the direction toward the back side of the intermediate transfer belt 125.

Figure 6:
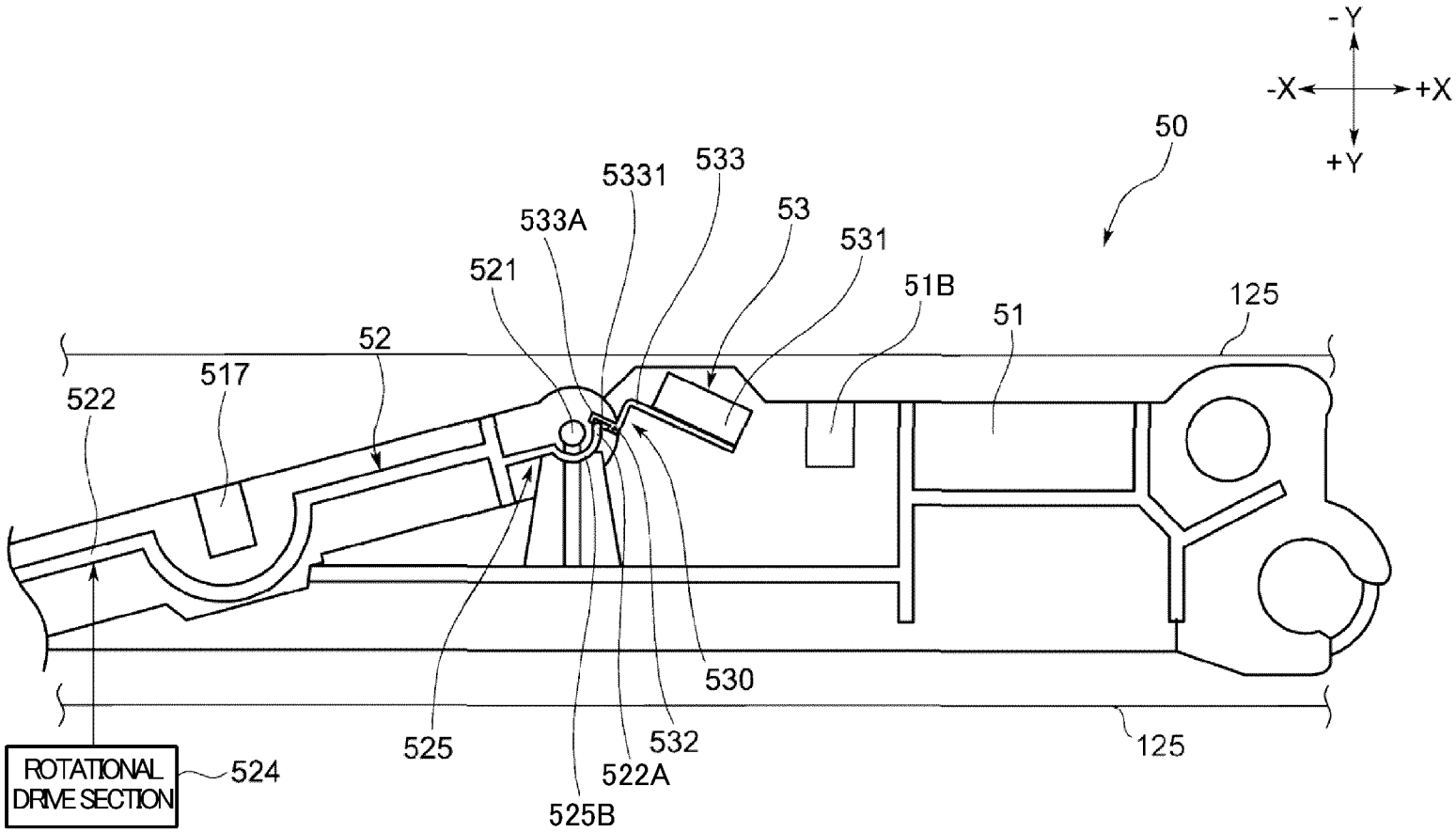
FIG. 6 is a side view showing a state where the drive mechanism has moved a first support member to a position where primary transfer rollers for formation of a multicolor image are out of contact with an intermediate transfer belt.

The frame 51 is provided with a bearing 51B for the primary transfer roller 126 for black. The first support member 522 is provided with a plurality of bearings 517 for the respective primary transfer rollers 126 for different colors for formation of a multicolor image. FIG. 5 and FIG. 6 described hereinafter show only the bearing 517 for the primary transfer roller 126 for yellow.

FIG. 6 is a side view showing a state where the drive mechanism 52 has moved the first support member 522 to a position where the primary transfer rollers 126 for formation of a multicolor image are out of contact with the intermediate transfer belt 125.

With reference to FIGS. 5 and 6, a description will be given of the operations of the drive mechanism 52 and the shifting mechanism 530.

FIG. 5 shows a state where the drive mechanism 52 has turned the first support member 522, by the aforementioned control over the rotation of the cam, to a position where the primary transfer rollers 126 for formation of a multicolor image come into contact with the back side of the intermediate transfer belt 125, wherein the cleaning member 531 is shown in contact with the back side of the intermediate transfer belt 125.

At this time, since the second support member 533 supporting the cleaning member 531 is pressed by the pressing member to turn the cleaning member 531 in the direction toward the back side of the intermediate transfer belt 125 (the direction −Y in FIG. 5), the second hooking portions 533A are urged to turn on the second pivot shafts 532 as fulcrums toward the +Y side in FIG. 5.

In this state, the first hooking portions 522A of the first support member 522 of the drive mechanism 52 enter the recesses 5331 of the second hooking portions 533A. The first support member 522 is pressed toward the +Y side (in the direction away from the back side of the intermediate transfer belt 125) by the aforementioned pressing part, but the cam allows the first support member 522 to keep s stable stop against turning due to the pressing. Therefore, the force of the second hooking portions 533A to turn toward the +Y side is restrained by the engagement of the second hooking portions 533A against the first hooking portions 522A.

Thus, the second support member 533 stops with the second hooking portions 533A engaging against the first hooking portions 522A and is held in this state. In the embodiment of the present disclosure, the attitude of the second support member 533 is set so that when the second support member 533 stops in this state, the top surface of the cleaning unit 531 is in contact with the back side of the intermediate transfer belt 125.

On the other hand, when the drive mechanism 52 turns the first support member 522 toward the +Y side, by the control over the rotation of the cam, to a position where the primary transfer rollers 126 for formation of a multicolor image are out of contact with the back side of the intermediate transfer belt 125, the first hooking portions 522A of the first support member 522 turn on the first pivot shafts 521 as fulcrums to come closer to the −Y side than their position shown in FIG. 5.

By the turning movement of the first hooking portions 522A toward the −Y side, the first hooking portions 522A press up the second hooking portions 533A hooked thereover to turn them toward the −Y side. The force of the first hooking portions 522A to press the second hooking portions 533A is set greater than the pressing force applied to the second support members 533 by the pressing member (the pressing force that allows the second support members 533 to turn in the direction in which the cleaning member 531 moves toward the back side of the intermediate transfer belt 125 (the direction −Y in FIG. 5)). Therefore, by the pressing of the first hooking portions 522A against the second hooking portions 533A, the cleaning member 531 side of the second support member 533 turns on the second pivot shafts 532 as fulcrums toward the +Y side (in the direction away from the back side of the intermediate transfer belt 125). In this case, the respective amounts of turning movement of the first support member 522 and the second support member 533 are set so that when the first support member 522 is moved to the position where the primary transfer rollers 126 for formation of a multicolor image are out of contact with the back side of the intermediate transfer belt 125, the cleaning member 531 is moved out of contact with the back side of the intermediate transfer belt 125 by the pressing of the first hooking portions 522A against the second hooking portions 533A.

To sum up, in the embodiment of the present disclosure, the first hooking portions 522A provided on the side of the first support member 522 closer to the shifting mechanism 530 than the first pivot shafts 521 and the second hooking portions 533A provided on the side of the second support member 533 closer to the drive mechanism 52 than the second pivot shafts 532 hook together. When in this state the rotational drive section 524 turns the first support member 522 in the direction in which the primary transfer rollers 126 for formation of a multicolor image move out of contact with the back side of the intermediate transfer belt 125, the first hooking portions 522A press the second hooking portions 533A to turn the second support member 533 on the second pivot shafts 532 as fulcrums in the direction in which the cleaning member 531 moves out of contact with the back side of the intermediate transfer belt 125.

Under this configuration, when the drive mechanism 52 moves the primary transfer rollers 126 for formation of a multicolor image to a position in contact with the intermediate transfer belt 125, the shifting mechanism 530 moves the cleaning member 531 to a position in contact with the back side of the intermediate transfer belt 125. On the other hand, when the drive mechanism 52 moves the primary transfer rollers 126 for formation of a multicolor image to a position out of contact with the intermediate transfer belt 125, the shifting mechanism 530 moves the cleaning member 531 to a position out of contact with the back side of the intermediate transfer belt 125.

Thus, in the embodiment of the present disclosure, the cleaning member 531 cleans the back side of the intermediate transfer belt 125 only during the formation of multicolor images. The back side of the intermediate transfer belt 125 has a relatively small amount of toner deposited thereon as compared to the front side thereof (the surface thereof to which toner images are transferred from the photosensitive drums 121) and therefore need not always be cleaned by contact with the cleaning member 531. Therefore, while a period of time for which the cleaning member 531 is made contact with the back side of the intermediate transfer belt 125 is ensured, the cleaning member 531 is kept out of contact with the back side of the intermediate transfer belt 125 for a certain period of time. Thus, the cleaning member 531 and the intermediate transfer belt 125 can be released from friction against each other for a certain period of time to extend their lives while the cleaning effect of the cleaning member 531 can be maintained.

Unlike this, in a general cleaning mechanism, the cleaning member is always made contact with the back side of the transfer belt to clean the back side by the friction of the cleaning member against the back side of the transfer belt. Therefore, the cleaning member and the transfer belt are reduced in life by abrasion.

The embodiment of the present disclosure can solve this problem. Specifically, the embodiment of the present disclosure can extend the lives of the cleaning member 531 and the intermediate transfer belt 125 while maintaining the cleaning effect of the cleaning member 531 on the back side of the intermediate transfer belt 125.

The image forming apparatus 1 of the present disclosure is not limited to the above embodiment and can be modified in various ways. For example, although in the embodiment of the present disclosure the cleaning member 531 is made contact with the back side of the intermediate transfer belt 125 by the turning of the second support members 533 during formation of a multicolor image, the attitudes and positions of the second support member 533 and the cleaning member 531 during formation of a multicolor image may be set so that when the cleaning member 531 makes contact with the back side of the intermediate transfer belt 125, the cleaning member 531 presses the intermediate transfer belt 125, which is mounted over the drive roller 125A and the driven roller 125B, outwardly from the inner side (back side) of the intermediate transfer belt 125 to allow the intermediate transfer belt 125 to bulge out. Thus, during formation of a multicolor image, the cleaning member 531, like the backup rollers, presses the intermediate transfer belt 125 mounted over the drive roller 125A and the driven roller 125B outwardly from inside the intermediate transfer belt 125. Therefore, tension can be applied to the intermediate transfer belt 125 not only by the backup rollers but also by the cleaning member 531.

Although in the embodiment of the present disclosure the description has been given of the intermediate transfer unit 50 configured so that toner images are transferred from the photosensitive drums 121 to the intermediate transfer belt 125, the present disclosure is not limited to this embodiment. For example, the present disclosure also includes an embodiment where a transfer unit is configured so that the transfer belt conveys a recording paper sheet P and toner images are transferred from the photosensitive drums 121 directly to the recording paper sheet P.

Although in the embodiment of the present disclosure the cleaning member 531 is made of an electrically conductive material, materials that are used for the cleaning member 531 are not limited to electrically conductive materials.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A transfer unit comprising:

a transfer belt mounted over a plurality of rollers to run thereover and configured so that respective toner images formed on a plurality of image carriers for different colors necessary to form multicolor and black-and-white images are transferred to a front side of the transfer belt or a recording medium placed on the front side of the transfer belt;

a plurality of transfer rollers provided for the respective image carriers and configured to give a transfer potential to the transfer belt to allow the toner images to be transferred to the transfer belt;

a drive mechanism configured to move, among the transfer rollers for formation of a multicolor image and the transfer roller for formation of a black-and-white image, the transfer rollers for formation of a multicolor image into and out of contact with the transfer belt;

a cleaning member capable of contact with a back side of the transfer belt and operable to clean the back side of the transfer belt; and a shifting mechanism configured to, when the drive mechanism moves the transfer rollers for formation of a multicolor image into contact with the transfer belt, shift the cleaning member to a position in contact with the back side of the transfer belt and, when the drive mechanism moves the transfer rollers for formation of a multicolor image out of contact with the transfer belt, shift the cleaning member to a position out of contact with the back side of the transfer belt, wherein the drive mechanism comprises a first pivot shaft extending in a direction along rotational axes of the rollers, a first support member configured to turn on the first pivot shaft as a fulcrum while supporting the transfer rollers for formation of a multicolor image arranged in a row in a direction of run of the transfer belt and thus turn the transfer rollers for formation of a multicolor image in directions toward and away from contact with the back side of the transfer belt, and a rotational drive section configured to drive and turn the first support member, wherein when the rotational drive section turns the first support member in a direction in which the transfer rollers for formation of a multicolor image move out of contact with the back side of the transfer belt, a rotational force of the rotational drive section is transmitted to the shifting mechanism through the first support member and the shifting mechanism shifts the cleaning member by the rotational force in a direction in which the cleaning member moves out of contact with the back side of the transfer belt, wherein the shifting mechanism comprises a second pivot shaft extending in the direction along the rotational axes of the rollers and a second support member configured to turn on the second pivot shaft as a fulcrum while supporting the cleaning member, the second pivot shaft and the second support member being located opposite a side of the first pivot shaft where the transfer rollers for formation of a multicolor image are disposed, and wherein the first support member is provided with a first hooking portion closer to the shifting mechanism than the first pivot shaft, the second support member is provided with a second hooking portion closer to the drive mechanism than the second pivot shaft, the first hooking portion and the second hooking portion hook together are configured so that when the rotational drive section turns the first support member in a direction in which the transfer rollers for formation of a multicolor image move out of contact with the back side of the transfer belt, the first hooking portion presses the second hooking portion to turn the second support member on the second pivot shaft as a fulcrum in a direction in which the cleaning member moves out of contact with the back side of the transfer belt.

* * * * *